United States Patent [19]

Jacobs

[11] 4,260,061

[45] Apr. 7, 1981

[54] BAG WITH OPENING AND RECLOSING FEATURE

[75] Inventor: Richard W. Jacobs, Eden Prairie, Minn.

[73] Assignee: Bemis Company, Inc., Minneapolis, Minn.

[21] Appl. No.: 54,847

[22] Filed: Jul. 5, 1979

[51] Int. Cl.[3] ..... B65D 33/20

[52] U.S. Cl. ..... 206/626; 206/632; 206/633; 229/62

[58] Field of Search ..... 206/626, 632, 610, 611, 206/612, 613, 605, 607, 608, 633; 229/62, 57, 58, 17 R

[56] References Cited

U.S. PATENT DOCUMENTS

| | | | |
|---|---|---|---|
| 2,153,310 | 4/1939 | Newman | 24/17 |
| 2,276,577 | 3/1942 | Hahn | 229/7 |
| 2,343,222 | 2/1944 | Nelson | 206/608 |
| 2,349,247 | 5/1944 | Coghill | 229/62 |
| 2,410,438 | 11/1946 | Fields | 206/632 X |
| 2,582,286 | 1/1952 | Schenck | 229/62 |
| 2,719,663 | 10/1955 | Meyer-Jagenberg | 206/626 X |
| 2,896,839 | 7/1959 | Barnes et al. | 229/62 |
| 2,946,496 | 7/1960 | Stagmeier | 229/17 R |
| 3,059,827 | 10/1962 | Pellaton et al. | 229/17 R |
| 3,093,292 | 6/1963 | Ahlbor . | |
| 3,259,303 | 7/1966 | Repko . | |
| 3,565,328 | 2/1971 | Hudson | 229/55 |
| 3,687,356 | 8/1972 | Goodrich et al. | 229/55 |
| 4,015,768 | 4/1977 | McLennan | 229/17 R |
| 4,043,503 | 8/1977 | Meyers et al. | 206/613 |

*Primary Examiner*—Stephen P. Garbe

*Attorney, Agent, or Firm*—Senniger, Powers, Leavitt and Roedel

[57] ABSTRACT

A paper bag having an inner ply and an outer ply with lines of perforations in the outer ply defining a flap adapted to be pulled back to open the bag, the inner ply having a transverse line of perforations underneath the flap, the plies being releasably adhered together by pressure-sensitive adhesive forward of the inner ply line of weakness and permanently adhered together rearward of the inner ply line of weakness, whereby after the bag has been filled and closed, the bag may be opened by pulling back the flap to tear the inner ply open rearward of the inner ply line of weakness and re-closed by adhering the flap to the inner ply forward of the inner ply line of weakness.

12 Claims, 10 Drawing Figures

BAG WITH OPENING AND RECLOSING FEATURE

BACKGROUND OF THE INVENTION

This invention relates to bags, and more particularly to a bag with an opening and reclosing feature.

The invention is especially concerned with paper bags for flour, e.g. five, ten and twenty-five pound bags of flour, which heretofore have not had any wholly satisfactory means for facilitating opening the bag for removal of part of the flour and for reclosing the bag to retain and protect the remainder of the flour. It will be understood, of course, that the bags may be used for products other than flour, e.g., sugar.

SUMMARY OF THE INVENTION

Among the several objects of the invention may be noted the provision of a bag, especially a paper bag for flour, with an easy opening and reclosing feature whereby the bag may be easily opened for removal of part of its contents and then easily reclosed as often as may be needed by the purchaser of the filled bag; the provision of such a bag which, as initially filled and closed and before being opened is substantially sift-proof; and the provision of such a bag which may be readily and economically manufactured utilizing available bag-manufacturing techniques and machinery, and without requiring any substantial extra materials or labor.

In general, a bag made in accordance with this invention has an inner ply and an outer ply, the outer ply having a pair of lines of weakness extending from an edge thereof in spaced relation to one another defining a closure flap adapted to be opened by grasping the outer ply at the edge and pulling it back to tear the closure flap away from the outer ply at the lines of weakness. The inner ply has a line of weakness underneath the closure flap extending between the outer ply lines of weakness spaced back from said edge of the outer ply. The plies are permanently adhered togehter rearward of the inner ply line of weakness for tearing open of a portion of the inner ply rearward of the inner ply line of weakness on pulling the closure flap back, and the plies are releasably and resealably adhered together forward of the inner ply line of weakness by pressure-sensitive adhesive. With this construction, after the bag has been filled and closed it may be opened by pulling away the closure flap, the latter separating from the inner ply, as enabled by the pressure-sensitive adhesive, back to the inner ply line of weakness, and then tearing the inner ply at and back from the line of weakness to form an opening in the bag for removal of the contents of the bag. The flap is then adapted to be re-adhered to the inner ply by the pressure-sensitive adhesive to close said opening.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Referring to FIGS. 1–4, a bag 1 made in accordance with this invention is shown to be a two-ply bag, the inner ply of which is designated 3 and the outer ply of which is designated 5. The bag having been developed especially for relatively small flour bags, e.g., five, ten or twenty-five pound flour bags, both plies are paper. It will be understood, however, that suitable materials other than paper may be used, and it will also be understood that while the plies for small bags will generally be single-layer plies, one or the other or both of the plies 3 and 5 may be multi-layer plies.

Figure 1:
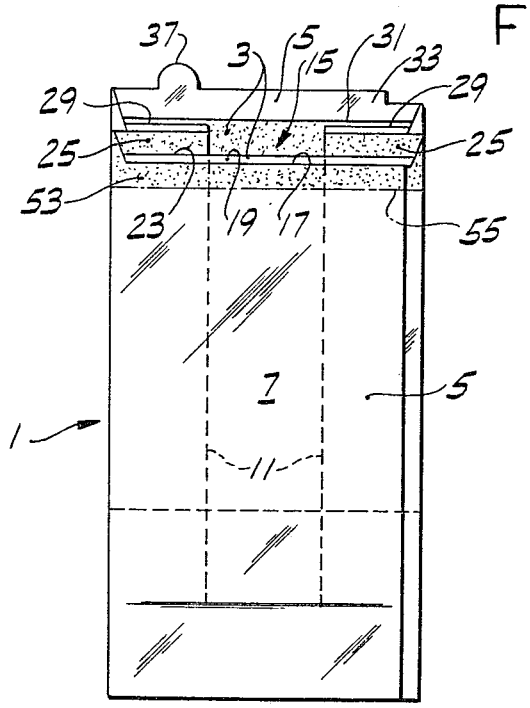
FIG. 1 is a view of one side of a two-ply bag made in accordance with this invention, showing the bag in its initial flat condition as it is manufactured, before it is filled and closed.
Figure 5:
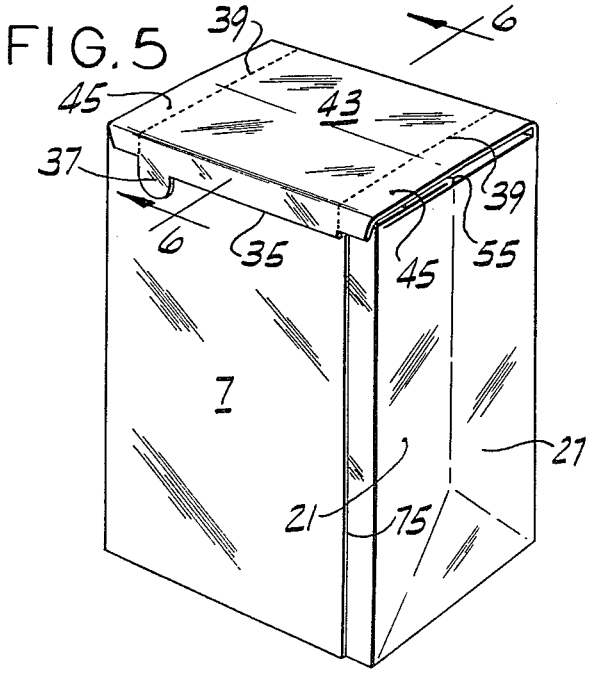
FIG. 5 is a perspective of the bag as it appears when filled and closed at the top.

The bag 1, as illustrated, is a gusseted open-mouth square bottom bag. The opposed walls of the bag are designated 7 and 9, 7 being referred to as the front wall and 9 as the back wall, the gussets are each designated 11 and the square bottom is designated 13. The open bag mouth is indicated at 15 at the top of the bag as shown in FIG. 1. The bag, shown in FIGS. 1 and 2 in its flat condition as manufactured and before filling, is adapted to be filled through the open mouth 15 (as with flour) and then closed at the top by a pinch top closure as illustrated in FIG. 5. For purposes of making the pinch top closure, the bag has a special pinch closure formation at the top in which, in the front wall 7 of the bag, the inner ply 3 extends up above the upper edge 17 of the outer ply, this extension of the inner ply in the front wall being designated 19. The front halves or panels 21 of the gussets 11 are stepped up above the upper edge 23 of the inner ply as indicated at 25, and the back halves or panels 27 of the gussets are stepped up as indicated at 29 above the upper end edges of the front gusset panels 21. In the back wall 9, the inner ply 3 is stepped up above the upper end edges of the back gusset panels 27 as indicated at 31 and the outer ply 5 is stepped up above the upper end edge of the inner ply 3 as indicated at 33. Thus, the back wall 9 extends up above the upper edge at 23 of the front wall. The upper edge of the outer ply 5 of the back wall 9 is specially designated 35. A tab 37 projects out (up) from this edge 35 adjacent one side of the bag.

The stepped formation described above for the mouth end of the bag is generally conventional except for the tab 37. It is adapted, after the bag has been filled, to be formed into a pinch top closure, as will appear, which is generally sift-proof.

In accordance with this invention, the outer ply 5 of back wall 9 of the bag (which is the longer wall), has a pair of lines of weakness each designated 39 extending down from the upper edge 35 of the outer ply of the back wall a distance which, as shown, may be somewhat greater than the full gusset width (the full gusset width determining the front to back dimension of the filled bag). These lines of weakness, which are preferably lines of perforations in the case of a paper bag, extend in parallel relation vertically downward from the upper edge 35 of the outer ply. The outer ply 5 of the back wall 9 may also have another line of weakness 41, e.g., a line of perforations, extending transversely with respect to the back wall of the bag between the lower ends of the vertical lines of weakness 39.

The lines of weakness 39 define what may be referred to as a closure flap 43 adapted (with regard to the filled and closed bag) to be opened by grasping the outer ply 5 of the back wall 9 at the edge 35 of the outer ply of the back wall and pulling it back to tear the closure flap away on the lines of weakness 39 from the portions 45 of the outer ply 5 of the back wall 9 on opposite sides of the lines of weakness 39.

The inner ply 3 of the back wall 9 has a line of weakness 47, e.g., a line of perforations, underneath the stated closure flap 43 extending generally transversely of the bag between the outer ply lines of weakness 39 and spaced back (down) from the upper edge 35 of the outer ply 9 of the back wall 5. This line of weakness 47 has end portions **47*a* extending downwardly and spaced inwardly from the outer ply lines of weakness 39**.

Figure 3:
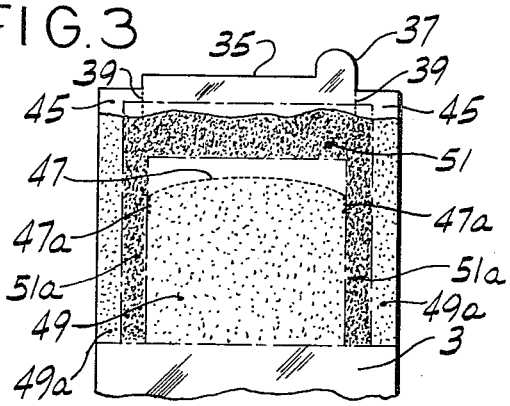
FIG. 3 is a fragment of FIG. 2 with the outer ply of the bag broken away in part to show a certain line of weakness in the inner ply of the bag and certain adhesive areas between the outer ply and inner ply.
Figure 6:
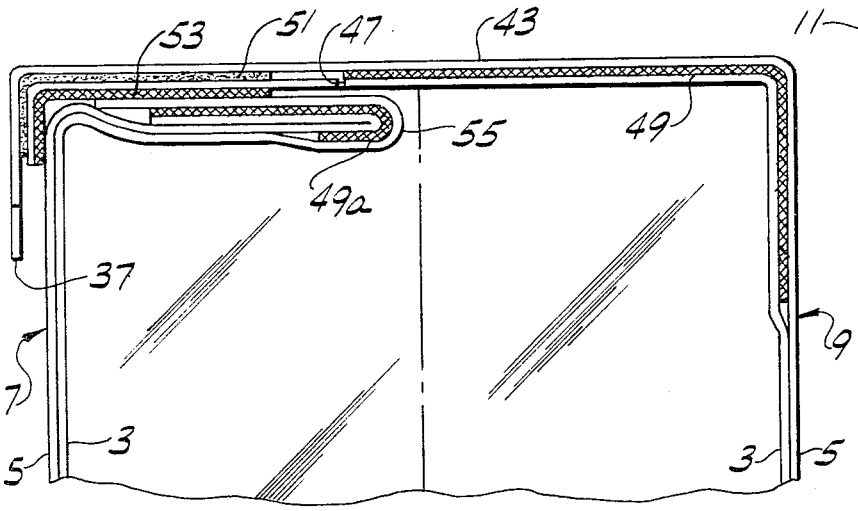
FIG. 6 is an enlarged vertical section on line 6—6 of FIG. 5, thicknesses being exaggerated, and cross-hatching being omitted so as not to obscure the illustration of adhesive between the plies.
Figure 7:
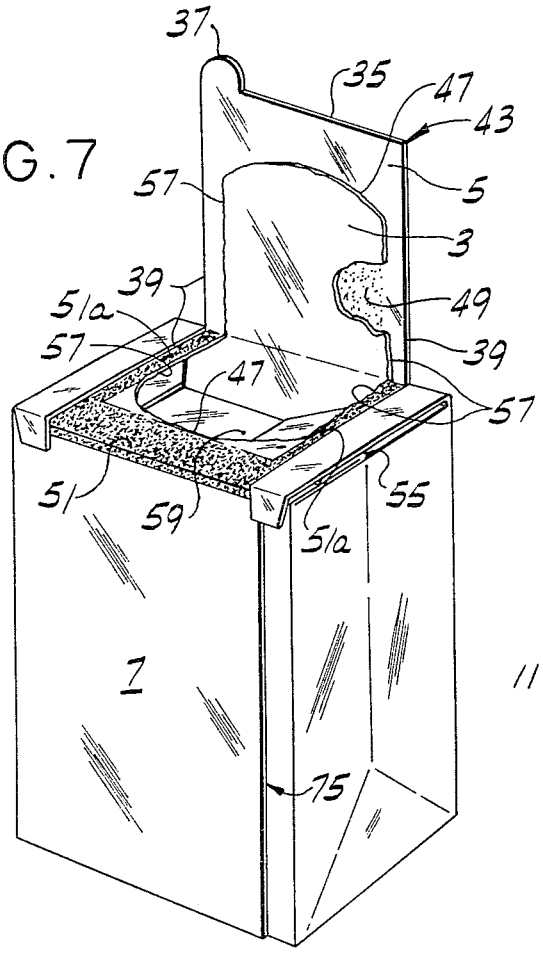
FIG. 7 is a view similar to FIG. 5 showing the bag opened.

The inner and outer plies 3 and 5 are permanently adhered together over an interfacial area thereof which is below the inner ply line of weakness 47 and hence rearward of this line of weakness in respect to the direction of pulling the flap 43 open. Generally, as shown in FIGS. 3, 6 and 7, this permanent adhesive is provided in an area 49 below the inner ply line of weakness 47 and between the outer ply lines of weakness 39. The inner and outer plies 3 and 5 are releasably and resealably adhered together by a suitable pressure sensitive adhesive in an interfacial area thereof which is above the inner ply line of weakness 47 and hence forward of this line of weakness in respect to the direction of pulling the flap 43 open. Generally, as shown in FIGS. 3, 6 and 7, this pressure-sensitive adhesive is provided between the plies of the back wall 9 in an upper area 51 between the upper (mouth) edge 31 of the inner ply 5 and the inner ply line of weakness 47, and extending out somewhat beyond the lines of weakness 39. The pressure-sensitive adhesive at 51 may be spaced somewhat above the line 47. The pressure-sensitive adhesive is also shown as applied in two relatively narrow bands **51*a* extending down from the opposite ends of the upper pressure-sensitive adhesive area 51 on the outside of and adjacent the end portions 47*a* of the line of weakness 47, with the inner edge of each band 51*a* on the inside of a respective line of weakness 39 and the outer edge of each band 51*a* between the respective line of weakness 39 and the respective side of the bag, the entire application of the pressure-sensitive adhesive thus being of inverted U-shape. Permanent adhesive may be applied between the inner and outer plies 3 and 5 outwardly of the bands 51*a* of pressure-sensitive adhesive, as indicated at 49*a*, extending up to the upper edge of the inner ply 3. The pressure-sensitive adhesive at 51*a* seals the outer ply lines of perforations 39. The adhesive used at 49 and 49*a*** may generally be the same as that used for the usual conventional pasting together (not shown) of the plies.

Figure 2:
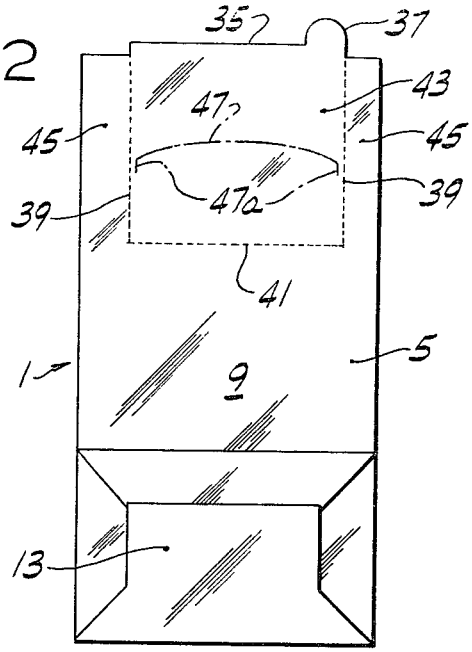
FIG. 2 is a view of the other side of the bag.
Figure 4:
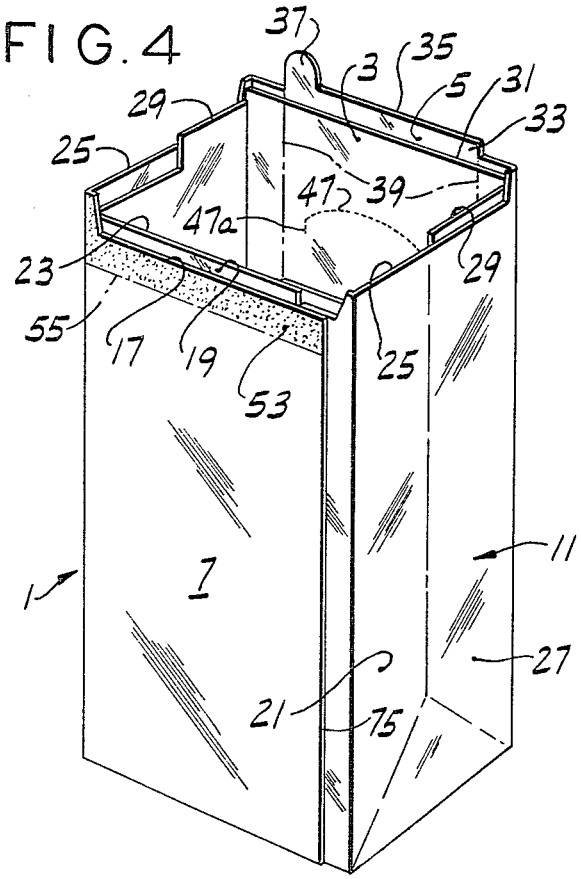
FIG. 4 is a perspective of the bag as it appears when filled but before it is closed at the top.

FIGS. 1 and 2 show the bag in its flat condition as supplied by the bag manufacturer to a flour mill, for example, for being packed with flour. As so supplied, the bag may have pre-applied heat reactivatable adhesive at the top in the area indicated at 53 in FIG. 1 above a pinch top closure fold line 55 and below the upper edge 31 of the inner ply of the back wall 9, for the formation of a pinch closure at the top as will appear. FIG. 4 shows the bag as it appears when it has been filled at the mill through its open mouth 15. After it has been filled, it is closed at the mill by the formation of a pinch closure at the top, involving tucking in of the gussets 11 at the sides of the bag on top of the flour, bringing the front and back walls of the bag together in face-to-face relation above the level of the flour, reactivating the adhesive 53, and then folding the entire portion of the bag above the line 55 (which then extends transversely across the bag walls in the central vertical transverse plane of the bag) down on the front wall 7 to adhere it to the latter by the adhesive 53. The bag top formation is such that, in the pinch top closure, what was the upper edge margin 33 of the back wall 7 of the bag with the tab 37 extends down from the top on the outside of the outer ply 5 of the front wall 7.

FIGS. 5 and 6 show the bag in its filled and closed state, FIG. 6 showing how the adhesive at 53 effects the closure of the bag. With the stepping of the plies 3 and 5, the stepping of the gusset panels 21 and 27, and the stepping of the back wall 9 up above the upper edges of the gusset panels, the closure is substantially sift-proof. While the inner ply 3 may have the line of perforations 47 therein, the bag is sift-proof (as regards sifting through the perforations) by reason of the adhesive pattern.

To open the bag, the closure flap 43 is grasped by the tab 37 and pulled back over the top of the bag in the direction away from the front wall 7 of the bag, the closure flap tearing away at the lines of perforations 39 from the portions 45 of the outer ply on opposite sides of lines 39. The closure flap readily separates from the inner ply 3 as enabled by the pressure-sensitive adhesive 51 back to the line of weakness 47 in the inner ply. Then, upon continued pulling back of the flap 43, the inner ply 3 is torn on the line 47 and, being permanently adhered to the flap 43 rearward of line 47, tears back along lines 57 extending rearward from the ends of line 47 as shown in FIG. 7 to provide an opening 59 in the top of the bag for removal of the contents of the bag, part at a time.

When the flap 43 is pulled back to provide the opening 59, the pressure-sensitive adhesive 51 on the top part of the inner ply 3 at the front of the opening 59 (and at **51*a*) is exposed. The flap is then adapted to be folded down and re-adhered to the inner ply 3** by the exposed pressure-sensitive adhesive. The flap may be re-opened and re-closed as needed.

Figure 8:
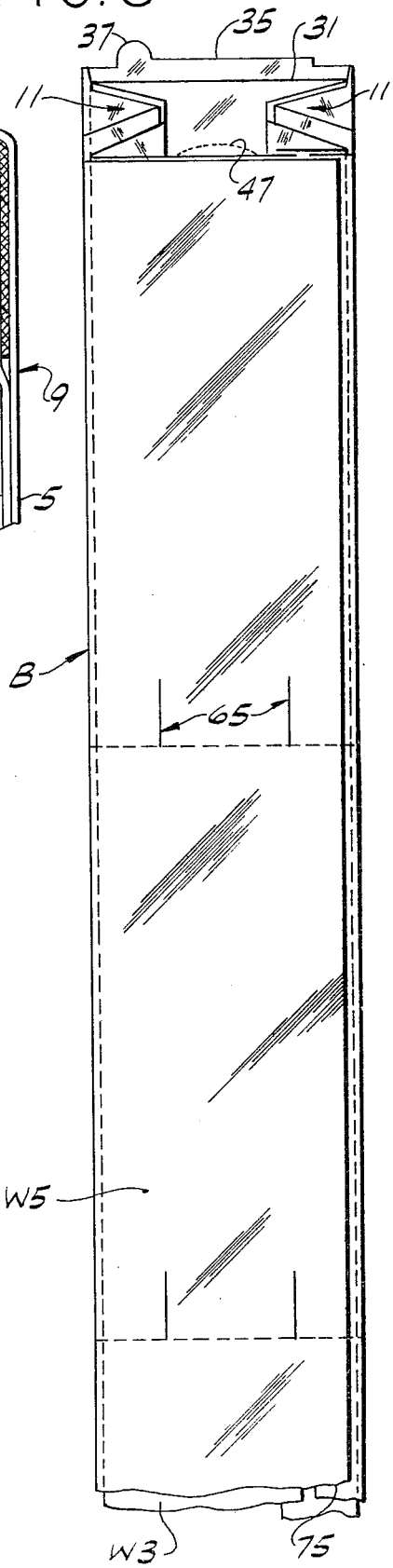
FIGS. 8–10 are views showing how the bags of this invention may be made by conventional bag-manufacturing techniques.
Figure 9:
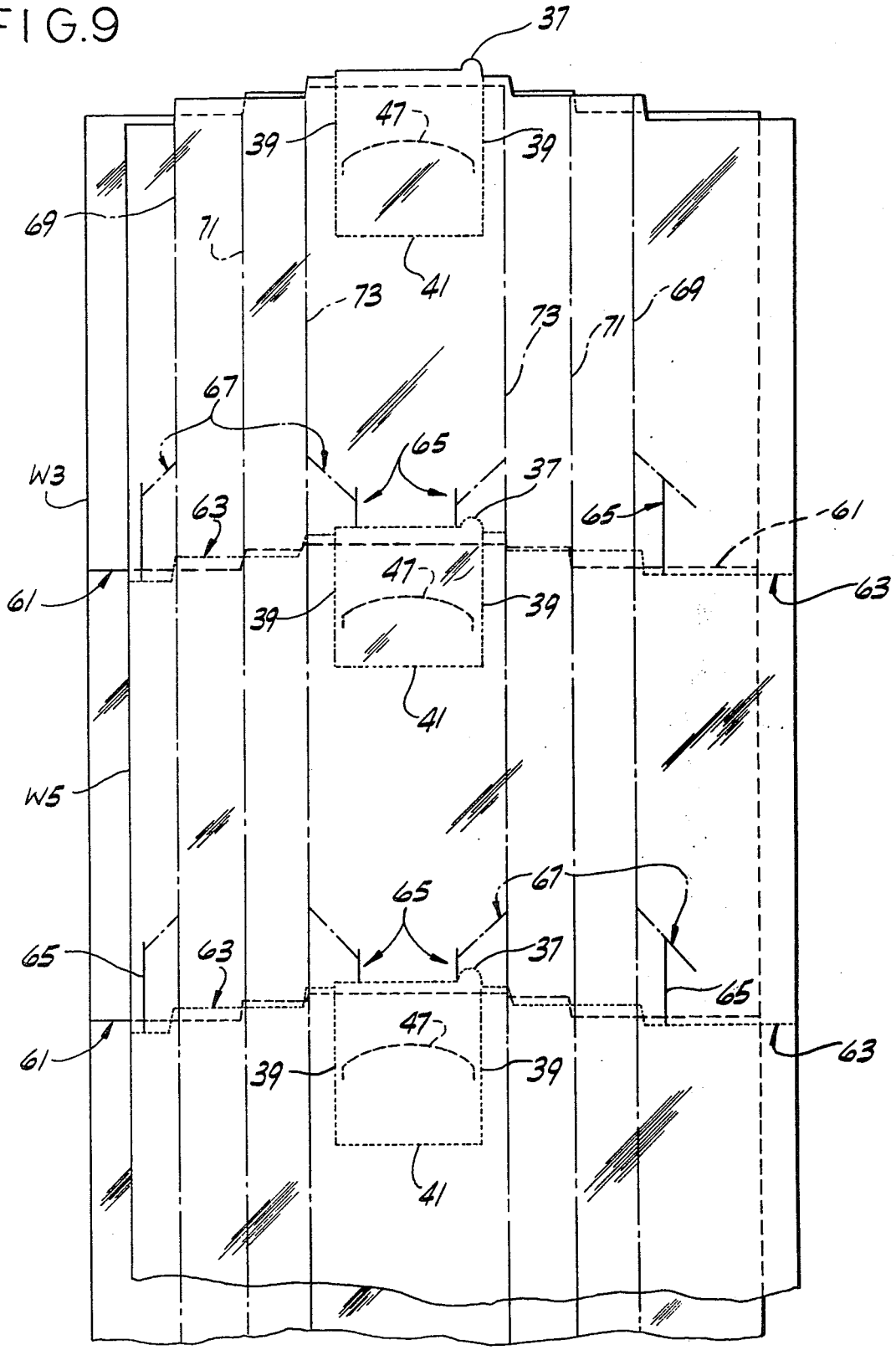
Figure 10:
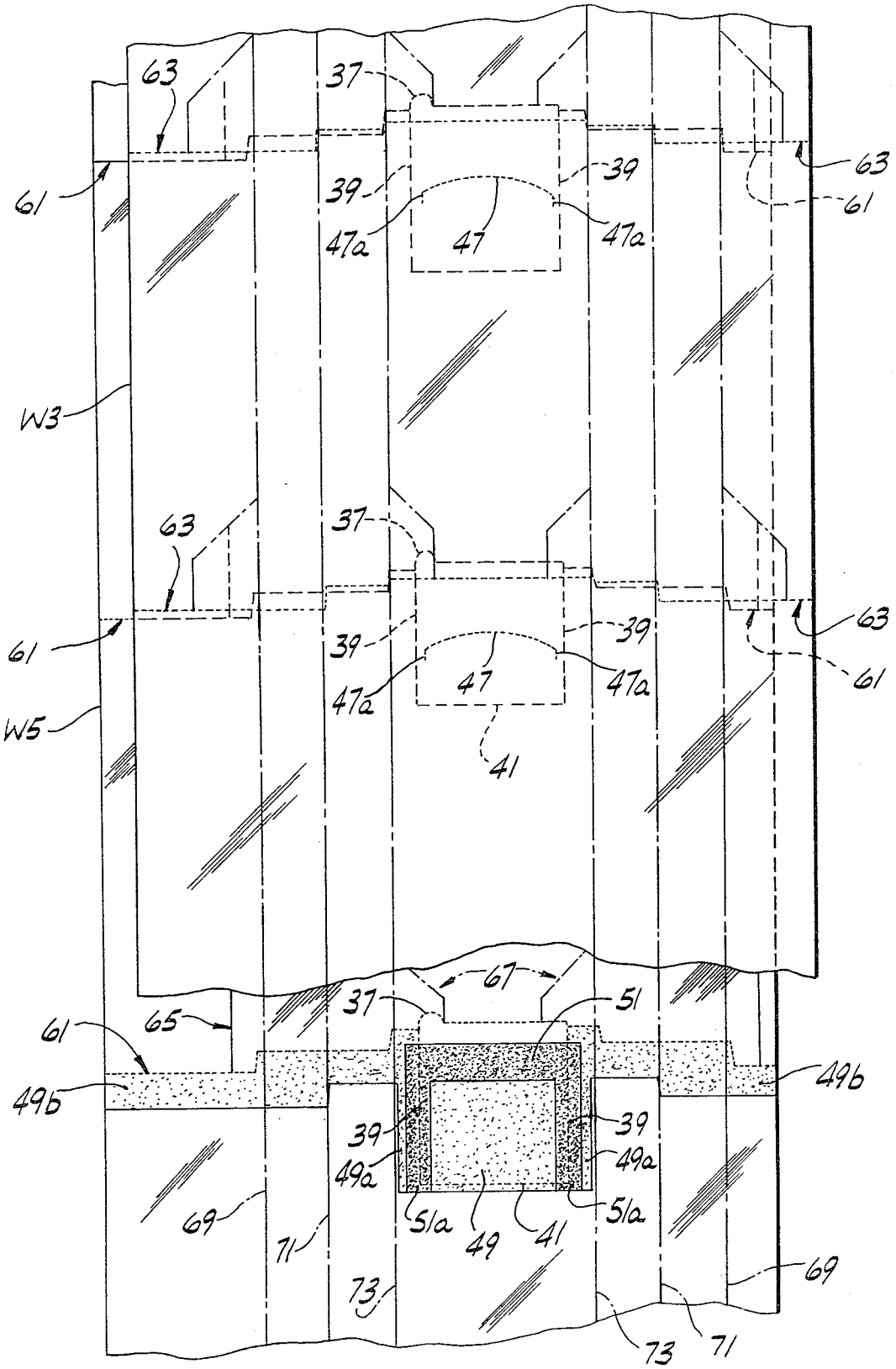

FIGS. 8–10 show how bags 1 may be manufactured by conventional bag-making techniques using conventional bag machinery by perforating, slitting and scoring two webs W3 and W5 as required for the formation of the square bottom 13 and the pinch top closure, combining the webs, forming them into tubing as shown in FIG. 8, and then separating the individual bags. Web W3 forms the inner ply of the bags and web W5 forms the outer ply. At 61 in FIGS. 9 and 10 is indicated the pattern of perforations made in the web W3 for the pinch top closure formation and at 63 is indicated the pattern of perforations made in the web W5 for this formation. The pattern of slits for the square bottoms is indicated at 65 and the pattern of scores for the square bottoms is indicated at 67. Score lines for the gussets 11 are indicated at 69, 71 and 73. As shown in FIGS. 9 and 10, the webs are combined in laterally offset relation as well understood in the art for the formation of a longitudinal seam 75 for the tubing shown in FIG. 8 made from the combined webs. The lines of perforations 39 are formed in the web W5, the lines of perforations 47 are formed in the web W3. Permanent adhesive is applied to one of the webs at 49 and 49*a* as well as in other areas such as indicated at 49*b* in FIG. 10 where the plies are to be permanently adhered together, and pressure sensitive adhesive is applied to the web W3 (which forms the inner ply of the bags) at 51 and 51*a*. The patterns in each web recur at bag tube length intervals and the webs are combined with the patterns in appropriate register at said intervals. The combined webs are formed into gussetted tubing as shown in FIG. 8 in conventional manner, bag tube lengths such as indicated at B in FIG. 8 being snapped off in conventional manner. Each bag tube length is then provided with the square bottom 13 and the reactivatable pinch top closure adhesive is applied at 53 in conventional manner.

It is contemplated that the closure flap 43 may be utilized as a coupon or a recipe sheet, having the necessary printing therefor on the portion of the outer ply 5 of the bag included in the flap, the flap being torn completely away from the bag on the line of perforations 41 after the bag has been completely emptied.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bag having opposed walls, a bottom closure, an open mouth, an inner ply, and an outer ply, the outer ply of one of said walls having a pair of lines of weakness extending from the mouth edge of said one of said walls in spaced relation to one another defining a closure flap adapted to be opened by grasping the outer ply at said edge and pulling it back to tear the closure flap away from the outer ply at said lines of weakness, the inner ply of said one of said walls having a line of weakness underneath said closure flap extending between said outer ply lines of weakness spaced back from said mouth edge of said one of said walls said plies being permanently adhered together rearward of said inner ply liine of weakness for tearing open of a portion of the inner ply rearward of said inner ply line of weakness on pulling said closure flap back, and said plies being releasably and resealably adhered together forward of said inner ply line of weakness by pressure-sensitive adhesive, whereby after the bag has been filled and closed it may be opened by pulling away said closure flap, the latter separating from the inner ply as enabled by the pressure-sensitive adhesive back to the inner ply line of weakness, and then tearing the inner ply at and back from the line of weakness to form an opening in the bag for removal of the contents of the bag, the flap being adapted to be re-adhered to the inner ply by the pressure-sensitive adhesive to close said opening.

2. A bag as set forth in claim 1 having another line of weakness in the outer ply of said one of said walls extending between the lower ends of the lines of weakness of said pair in the outer ply for complete tearing away of the closure flap after the bag has been completely emptied.

3. A bag having an inner ply and an outer ply, the outer ply having a pair of lines of weakness extending from an edge thereof in spaced relation to one another defining a closure flap adapted to be opened by grasping the outer ply at said edge and pulling it back to tear the closure flap away from the outer ply at said lines of weakness, the inner ply having a line of weakness underneath said closure flap extending between said outer ply lines of weakness spaced back from said edge of the outer ply, said plies being permanently adhered together rearward of said inner ply line of weakness for tearing open of a portion of the inner ply rearward of said inner ply line of weakness on pulling said closure flap back, and said plies being releasably and resealably adhered together forward of said inner ply line of weakness by pressure-sensitive adhesive, whereby after the bag has been filled and closed it may be opened by pulling away said closure flap, the latter separating from the inner ply as enabled by the pressure-sensitive adhesive back to the inner ply line of weakness, and then tearing the inner ply at and back from the line of weakness to form an opening in the bag for removal of the contents of the bag, the flap being adapted to be re-adhered to the inner ply by the pressure-sensitive adhesive to close said opening, said bag having opposed walls, a bottom closure and an open mouth, said pair of lines of weakness in the outer ply extending down from the mouth edge of one of the walls, said line of weakness in the inner ply being spaced down from said mouth edge, said pressure-sensitive adhesive being provided in an upper area between said mouth edge and said inner ply line of weakness, the plies being permanently adhered together below said inner ply line of weakness.

4. A bag as set forth in claim 3 wherein all said lines of weakness are lines of perforations, the bag further having pressure-sensitive adhesive between the plies extending down from said upper area of pressure-sensitive adhesive below the inner ply line of perforations adjacent the ends of the latter.

5. A bag as set forth in claim 3 wherein said inner ply line of weakness has end portions extending downwardly and spaced inwardly from said outer ply lines of weakness.

6. A bag as set forth in claim 5 wherein all said lines of weakness are lines of perforations, said upper area of pressure-sensitive adhesive extending outwardly beyond the outer ply lines of perforations, the bag further having bands of pressure-sensitive adhesive extending down from the ends of said upper area on the outside of said end portions of the inner ply line of perforations and sealing the outer ply lines of perforations.

7. A bag having an inner ply and an outer ply, the outer ply having a pair of lines of weakness extending from an edge thereof in spaced relation to one another defining a closure flap adapted to be opened by grasping the outer ply at said edge and pulling it back to tear the closure flap away from the outer ply at said lines of weakness, the inner ply having a line of weakness underneath said closure flap extending between said outer ply lines of weakness spaced back from said edge of the outer ply, said plies being permanently adhered together rearward of said inner ply line of weakness for tearing open of a portion of the inner ply rearward of said inner ply line of weakness on pulling said closure flap back, and said plies being releasably and resealably adhered together forward of said inner ply line of weakness by pressure-sensitive adhesive, whereby after the bag has been filled and closed it may be opened by pulling away said closure flap, the latter separating from the inner ply as enabled by the pressure-sensitive adhesive back to the inner ply line of weakness, and then tearing the inner ply at and back from the line of weakness to form an opening in the bag for removal of the contents of the bag, the flap being adapted to be re-adhered to the inner ply by the pressure-sensitive adhesive to close said opening, said bag having a front wall and a back wall, gussets at the sides, a bottom closure and an open mouth, the back wall extending up above the upper edge of the front wall for the formation of a pinch top closure after the bag has been filled, by tucking in the gussets and folding over an upper portion of the walls on a transverse fold line and adhering it down, said pair of lines of weakness in the outer ply extending down from the mouth edge of the back wall, said line of weakness in the inner ply being spaced down from said mouth edge, said pressure-sensitive adhesive being provided in an upper area between said mouth edge and said inner ply line of weakness, the plies being permanently adhered together below said inner ply line of weakness.

8. A bag as set forth in claim 7 wherein all said lines of weakness are lines of perforations, the bag further having pressure-sensitive adhesive between the plies extending down from said upper area of pressure-sensitive adhesive below the inner ply line of perforations adjacent the ends of the latter.

9. A bag as set forth in claim 7 wherein the outer ply of the bag extends up beyond the inner ply in the back wall, providing an extending end for the closure flap which may be left free of the front wall in the pinch top closure for the grasping of the closure flap at said end to pull it back.

10. A bag as set forth in claim 9 wherein the outer ply of the bag is formed with a tab at said extending end of the closure flap.

11. A bag as set forth in claim 9 wherein said inner ply line of weakness has end portions extending downwardly and spaced inwardly from said outer ply lines of weakness.

12. A bag as set forth in claim 11 wherein all said lines of weakness are lines of perforations, said upper area of pressure-sensitive adhesive extending outwardly beyond the outer ply lines of perforations, the bag further having bands of pressure-sensitive adhesive extending down from the ends of said upper area on the outside of said end portions of the inner ply line of perforations and sealing the outer ply lines of perforations.

* * * * *